US005988869A

United States Patent [19]

Davidson et al.

[11] Patent Number: 5,988,869

[45] Date of Patent: Nov. 23, 1999

[54] AGITATOR FOR ORBITAL AGITATION

[75] Inventors: Jeffrey Bruce Davidson, Burlington; Ilya Feygin, Mountainside, both of N.J.; Raymond Fredrick Gastgeb, Doylestown, Pa.

[73] Assignee: Pharmacopeia, Inc., Princeton, N.J.

[21] Appl. No.: 09/124,497

[22] Filed: Jul. 29, 1998

[51] Int. Cl.[6] ..... B01F 11/00

[52] U.S. Cl. ..... 366/208

[58] Field of Search ..... 366/110–112, 114, 366/208–213, 215–217, 219

[56] References Cited

U.S. PATENT DOCUMENTS

| | | | |
|---|---|---|---|
| 1,767,601 | 6/1930 | Miller | 366/208 |
| 3,128,082 | 4/1964 | Cline | 366/210 |
| 3,539,156 | 11/1970 | Zipperer et al. . | |
| 4,125,335 | 11/1978 | Blume et al. | 366/209 |
| 4,147,516 | 4/1979 | DeBruyne | 366/116 |
| 4,183,677 | 1/1980 | DeBruyne | 366/209 |
| 4,422,768 | 12/1983 | Solomon | 366/110 |
| 4,619,532 | 10/1986 | Schmidt, III | 366/110 |
| 4,702,610 | 10/1987 | Reynolds, Jr. | 366/213 |
| 4,834,548 | 5/1989 | Tempel et al. | 366/208 |
| 4,929,087 | 5/1990 | Brigolle | 366/208 |
| 5,593,228 | 1/1997 | Tannenbaum | 366/208 |
| 5,655,836 | 8/1997 | Preston et al. | 366/208 |
| 5,833,362 | 11/1998 | Shepard | 366/212 |

FOREIGN PATENT DOCUMENTS

| | | | |
|---|---|---|---|
| 2-187138 | 7/1990 | Japan | 366/208 |
| 1387402 | 3/1975 | United Kingdom | 366/217 |

OTHER PUBLICATIONS

Product Brochure: Elmeco's Line of Mixers, The Rock 'N' Roller, Mar. 1996.

*Primary Examiner*—Charles E. Cooley
*Attorney, Agent, or Firm*—DeMont & Breyer

[57] ABSTRACT

An agitator capable of generating complex mixing motions is described. In some embodiments, an agitator in accordance with the present teachings includes a movable assembly that is suspended, via several resilient supports, from a frame. The movable assembly receives a vessel containing a material(s) to be agitated. The movable assembly advantageously includes spaced upper and lower plates having a rotatably-supported member disposed therebetween. The mass of the rotatably-supported member is asymmetrically distributed about its rotational axis. A drive force, such as a directed air flow, which may be used in conjunction with a belt drive mechanism, causes the rotatably-supported member to rotate. Due to the asymmetric mass distribution of the rotatably-supported member, force is non-uniformly applied to resilient supports such that, at any given time, some of such resilient supports are subjected to a compressive force while other resilient supports are placed under tension. The particular resilient supports that are subjected to the compressive force change as a function of the rotation of the rotatably-supported member, thereby placing the movable assembly in orbital motion and agitating the material(s) within the vessel disposed thereon.

20 Claims, 5 Drawing Sheets

AGITATOR FOR ORBITAL AGITATION

FIELD OF THE INVENTION

The present invention relates generally to devices useful for agitating or stirring substances contained within a vessel. More particularly, the present invention relates to a device capable of generating a vortex or other efficient mixing motion within a substance contained in a vessel.

BACKGROUND OF THE INVENTION

It is often desirable to agitate/stir substances that are contained within a vessel. Such agitation is useful, for example, for increasing mass and heat transfer coefficients to promote chemical reaction, among other purposes.

Many different types of agitators are known. One type of widely-used agitator is an orbital shaker/agitator. Orbital shakers are used, primarily, for generating a vortex of material within a vessel. Such shakers typically comprise a platform moving in orbital fashion. Large-sized orbital shakers (e.g., platform size greater than about 20 centimeters) characteristically suffer from control and reliability problems. In particular, such shakers have a limited ability to withstand significant mechanical stresses that they receive due to the intense agitation of the relatively large platforms supporting massive loads. On the other hand, small-sized orbital shakers, which are used for agitating small vessels and microtiter plates, are difficult to implement as such shakers must generate very rapid movements with a small, controllable amplitude. Due to the aforementioned difficulties or limitations, orbital shakers tend to be rather expensive and unreliable.

Both large- and small-sized orbital shakers are often integrated into automated fluid handling systems. Such integration typically requires that the orbital shaker must include appropriate means for stopping the platform such that it comes to rest in a predefined position. Existing "robotic-friendly" shakers typically include a "home-position" sensor and related control circuitry to accomplish such a task. The sensor and circuitry increase the complexity of orbital shakers, thereby increasing the expense of and reliability problems with such devices.

In view of the foregoing, the art would benefit from an inexpensive and reliable agitation device capable of generating a vortex or other efficient mixing motions within a captive fluid in both large and small containers. It would be particularly desirable for such a device to be capable of returning to a home position when agitation stops.

SUMMARY OF THE INVENTION

An agitator capable of generating complex mixing motions is described. Such complex mixing motions include, for example, forming a vortex in a captive substance. In some embodiments, an agitator in accordance with the present teachings includes a movable assembly that is suspended, via several resilient supports, from a frame.

The movable assembly advantageously comprises spaced upper and lower plates having a rotatably-supported member disposed therebetween. The mass of the rotatably-supported member is asymmetrically distributed about its rotational axis. A drive means causes the rotatably-supported member to rotate. Due to the asymmetric mass distribution of the rotatably-supported member, force is non-uniformly applied to resilient supports such that, at any given time, some of such resilient supports are subjected to a compressive force while other resilient supports are placed under tension. The particular resilient supports that are subjected to the compressive force change as a function of the rotation of the rotatably-supported member, thereby placing the movable assembly in orbital motion. Such orbital motion generates complex mixing motions, such as a vortex, in material retained within a container located on a receiving surface of the movable assembly.

DETAILED DESCRIPTION OF THE INVENTION

Figure 1:
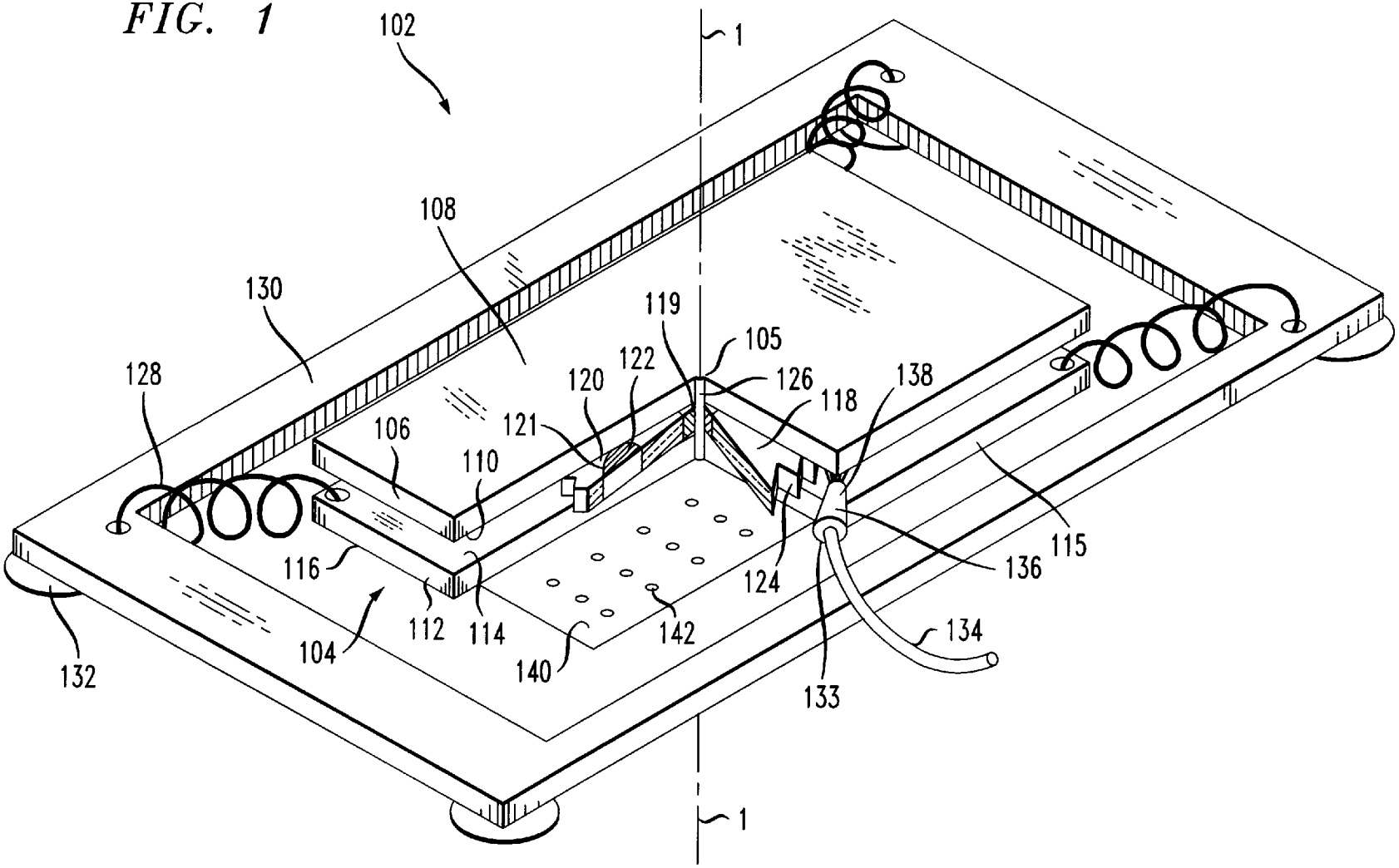
FIG. 1 depicts an agitator in accordance with an illustrative embodiment of the present invention.

FIG. 1 depicts agitator 102 in accordance with an illustrative embodiment of the present invention. Illustrative agitator 102 comprises movable assembly 104 which has a receiving surface 108. In use, a container (not shown) such as, for example, a microtiter plate, a flask, a test-tube rack containing test-tubes, or the like is placed on receiving surface 108. As movable assembly 104 moves, such movement agitates material retained in the container. In some embodiments, receiving surface 108 includes guides or other structures (not shown) for preventing a container from sliding off of the receiving surface 108 when assembly 104 is in motion.

In the embodiment depicted in FIG. 1, movable assembly 104 is suspended within frame 130 via resilient supports 128 that attach to lower plate 112 of the movable assembly. Frame 130 is advantageously rigid so that energy developed in movable assembly 104 is not dissipated within said frame. Frame 130 may be suitably formed, for example, from plastic. Moreover, frame 130 is advantageously attachable to a supporting surface (e.g., bench top), or otherwise capable of being immobilized, so that energy developed in the movable assembly does not cause agitator 102 to move or "walk" across the supporting surface. In the embodiment depicted in FIG. 1, attachment devices 132, realized in the illustrated embodiment as suction cups depending from frame 130, temporarily secure said frame to a supporting surface.

In the illustrated embodiment, resilient supports 128 are springs. It should be understood, however, that other devices or arrangements possessing the characteristic resilience of a spring and its ability to store energy under compression and tension, may suitably be used as resilient supports 128. In addition to supporting movable assembly 104 above a bench top or other surface so that it is free to move in orbital motion, the resilient supports "guide" movable assembly 104 into orbital motion and serve as a centering means, as described later in this specification.

In the illustrative embodiment depicted in FIG. 1, movable assembly 104 comprises spaced upper and lower plates 106 and 112, respectively. Posts or the like (not shown), are used for spacing the upper and lower plates. Rotatably-supported member 118, shown in partial section for clarity of illustration, is disposed in the space between the upper and lower plates. In the illustrated embodiment, rotatably-supported member 118 is rotatable about pin 126 that passes through said rotatably-supported member 118 and defines the rotational axis 1—1 thereof. In the embodiment depicted in FIG. 1, rotational axis 1—1 is advantageously located at the geometric center 105 of movable assembly 104 and at the center 119 of rotatably-supported member 118. Pin 126 is received by a retaining member (not shown) located on inner opposed surfaces 110 and 114 of each of respective upper and lower plates 106 and 112. In one embodiment, the retaining member is simply a hole in each plate that receives pin 126.

Figure 2:
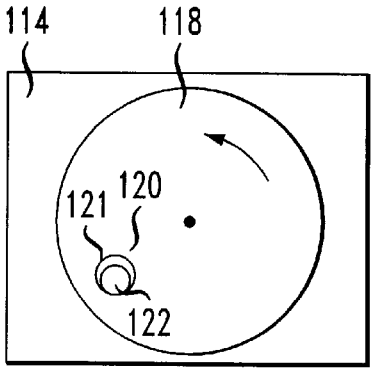
FIG. 2 depicts a first embodiment of a rotatably-supported member having an asymmetric weight distribution.

The mass of rotatably-supported member 118 is asymmetrically distributed about rotational axis 1—1 (hereinafter referred to as an "asymmetrical mass distribution"). Such a rotationally asymmetrical mass distribution may be accomplished in a variety of ways, as described below. In the embodiment depicted in FIG. 1, an asymmetric mass distribution is achieved by increasing the mass of the rotatably-supported member 118 at a selected eccentric location (i.e., not situated at the geometric center 119 and rotational axis 1—1 of rotatably supported member 118), such as location 120. In the illustrated embodiment, such an increase in mass is implemented by disposing load element 122 in bore 121 at location 120. The aforementioned arrangement wherein an additional mass is located off the rotational axis is illustrated by plan view in FIG. 2.

It will be recognized that numerous and varied other arrangements that provide an asymmetric mass loading may suitably be used in conjunction with the present invention. A few of such other arrangements are described below.

Figure 3:
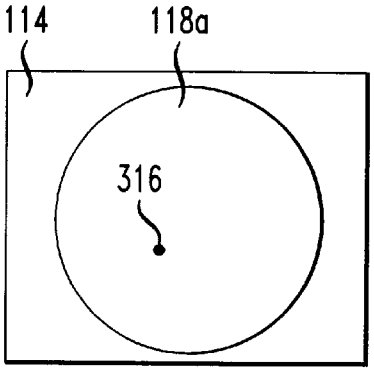
FIG. 3 depicts a first alternate embodiment of a rotatably-supported member having an asymmetric weight distribution.
Figure 4:
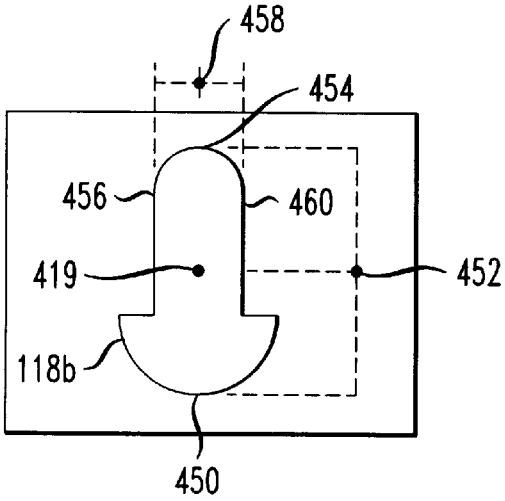
FIG. 4 depicts a second alternate embodiment of a rotatably-supported member having an asymmetric weight distribution.

In a first alternate embodiment depicted in FIG. 3, an asymmetric mass loading is achieved by locating the rotational axis of rotatably-supported member 118*a* at an off-center location 316. In a second alternate embodiment depicted in FIG. 4, an asymmetric mass loading is achieved by providing an asymmetrically-shaped rotatably-supported member 118*b*. Thus, even though the rotational axis is located at a point 419 that is at the midpoint 452 between edge 450 and 454, and at a midpoint 458 between edge 456 and edge 460, the mass of rotatably-supported member 118*b* can be seen to be asymmetrically distributed about rotational axis 1—1.

Figure 5:
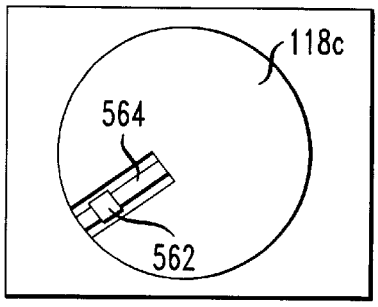
FIG. 5 depicts a third alternate embodiment of a rotatably-supported member having an asymmetric weight distribution.

In a third alternate embodiment depicted in FIG. 5, weight 562 is engaged to rod 564 such that the weight is movable along the rod in a radial direction. Such an arrangement provides a variable asymmetric mass loading to rotatably-supported member 118*c*. By way of example, rod 564 may be implemented as a screw, and weight 562 may be implemented as a nut, with the nut and screw joined in threaded engagement.

Drive 133, described in more detail later in this specification, causes rotatably-supported member 118 to rotate. Due to the asymmetric mass distribution of rotatably-supported member 118, force is non-uniformly applied to resilient supports 128 such that, at any given time, two of such resilient supports are subjected to a compressive force while the other two resilient supports are placed under tension. The two resilient supports that are subjected to the compressive force change as a function of the rotation of rotatably-supported member 118 (i.e., the angular position of load element 122), thereby guiding movable assembly 104 in orbital motion.

By virtue of its structure, illustrative agitator 102 of FIG. 1 advantageously returns movable assembly 104 to a "zero" or "home" position when agitation motion ceases. In agitator 102, such a homing function is provided by resilient supports 128. The four identical resilient supports 128 of agitator 102 advantageously return movable assembly 104 to the center of stationary frame 130.

In some embodiments, an agitator in accordance with the present teachings includes a secondary support device for keeping movable assembly 104 suspended above the supporting surface (e.g., bench top). In the embodiment depicted in FIG. 1, such a secondary support device is realized as distribution plate 140. Distribution plate 140 includes a plurality of holes 142 and a feed line (not shown). Compressed air or other conveniently available gas/vapor (hereinafter "lift gas") is directed through the feed line and into distribution plate 140. The lift gas flows through holes 142 impacting lower surface 116 of lower plate 112 of movable assembly 104. The force of the lift gas against lower surface 116 "floats" movable assembly 104 ensuring that, in use, the movable assembly does not contact the support surface, which contact would hinder motion.

In the illustrated embodiment, rotatably-supported member 118 is driven by compressed air, or another conveniently available gas/vapor (hereinafter "drive gas"). The drive gas is advantageously delivered to rotatably-supported member 118 via nozzle 136 that depends from an end of drive gas feed conduit 134. Nozzle end 138 directs drive gas between upper and lower plates 106 and 112 of movable member 104 towards rotatably-supported member 118. More particularly, nozzle end 138 delivers the drive gas to the perimeter of rotatably-supported member 118 along a path that is substantially tangential to said perimeter. Drive gas impacting the perimeter of rotatably-supported member 118 causes the rotatably-supported member to rotate.

It will be appreciated that the rate of rotation of movable member 118 is primarily dependent upon the rate of flow of the drive gas from nozzle end 138 and the efficiency of energy transfer from the drive gas to movable member 118. To improve the efficiency of energy transfer to rotatably-supported member 118, the perimeter of the rotatably-supported member is physically adapted, in some embodiments, to capture the tangentially-directed drive gas. In the embodiment depicted in FIG. 1, such an adaptation takes the form of uniform serrations 124, akin to the circumferentially-disposed "teeth" of a gear. In another embodiment, the physical adaptation can be circumferentially-disposed "vanes," as used in turbines. In still other embodiments, the rotatably-supported member 118 can be optimized for energy capture, wherein, for example, the serrations may be non-uniform in size and/or spacing.

Figure 6:
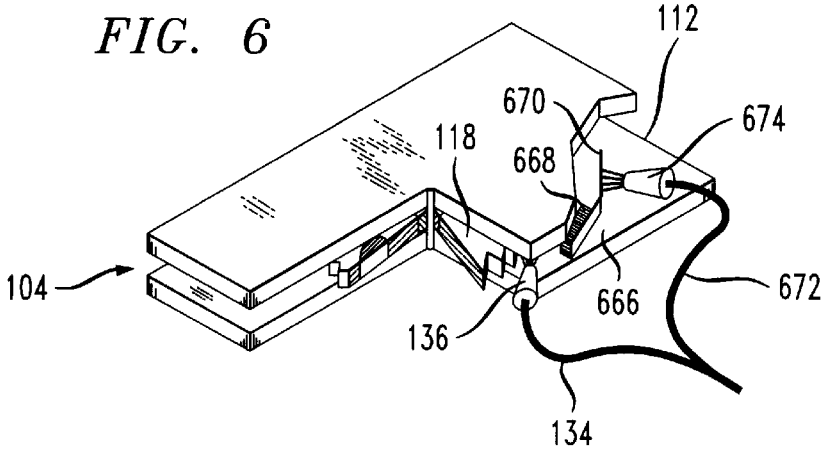
FIG. 6 depicts a first illustrative embodiment of a braking mechanism for slowing the motion of the movable assembly.
Figure 7:
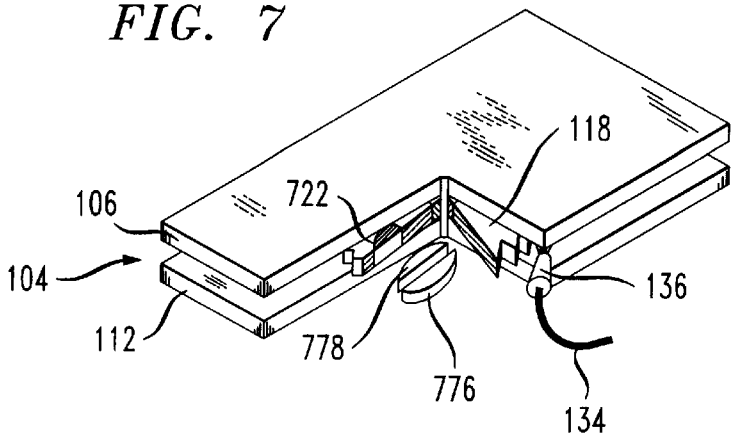
FIG. 7 depicts a second illustrative embodiment of a braking mechanism for slowing the motion of the movable assembly.

When the flow of drive gas is stopped, movable platform 104 will come to rest at its home position. To accelerate that process, an agitator in accordance with the present invention includes, in some embodiments, a braking mechanism. In a first embodiment depicted in FIG. 6, such a braking mechanism consists of spring-loaded braking brush 666 actuated by auxiliary gas nozzle 674 fed by conduit 672. During operation of the agitator, a slip-stream of drive gas is diverted, via conduit 672, to receiving surface 670 of braking brush 666. The force of the gas against receiving surface 670 overcomes the tendency of a biasing member (not shown) to bias braking surface 668 against rotatably-supported member 118. When the flow of drive gas is stopped, the biasing member biases braking surface 668 against rotatably-supported member 118, thereby providing braking action. FIG. 7 depicts a second embodiment of a braking mechanism that is particularly well suited for use with agitators that utilize a load element (see FIGS. 2 and 5) for providing the required asymmetric mass distribution. The braking mechanism comprises an electrically-activated magnet, depicted as poles 776 and 778, that is disposed within the lower plate 112 or upper plate 106 of the movable assembly 104. In such embodiments, the load element advantageously comprises a magnetic material. Thus, to stop the agitator, drive gas is cut off and the magnet is energized. The ensuing magnetic interaction between magnet 776/778 and magnetic load element 722 rapidly stops rotatably-supported member 118.

The characteristics of the orbital motion of movable platform 104 are primarily dependent upon (1) geometric parameters; (2) the "spring" constant of the resilient supports; (3) the specifics of the asymmetric weight distribution; and (4) the rate of rotation of the rotatably-supported member 118. The effect of each of such parameters on the orbital motion of movable platform 104 is described below.

Geometric parameters determine the precise shape of the orbital motion. More particularly, with regard to illustrative agitator 102, one resilient support 128 depends from each corner of rectangularly-shaped lower plate 112 of movable assembly 104. For such an arrangement, the "orbit" is oval or ellipsoidal in shape. In another embodiment, a circular orbit is obtained by moving the attachment points of resilient supports 128 inwardly along long edges 115 of lower plate 112 such that the attachment points define a square. A circular orbital motion can also be obtained by attaching the resilient supports 128 to the corners of a square-shaped lower plate.

The amplitude of motion of movable assembly 104 is determined, in part, by the "spring" constant of resilient supports 128. The spring constant and the amplitude of motion have an inverse relationship. For example, a relatively larger spring constant results in a relatively smaller amplitude of motion, and vice versa. Additionally, the amplitude of motion is influenced by the asymmetric mass distribution of rotatably-supported member 118. More particularly, with respect to the illustrative embodiment depicted in FIG. 1, the radial position and weight of load element 122 influences amplitude. The closer that load element 122 is to the perimeter of rotatably-supported member 118, or the greater the weight of load element 122, the larger the amplitude of motion. The frequency of the orbital motion of movable assembly 104 is determined by rate at which rotatably-supported member 118 is driven.

While mathematical expressions that quantitatively describe the aforementioned relationships can be developed, such expressions do not describe the behavior of a captive fluid being agitated by the present agitator. Rather, given an agitator comprised of selected components (e.g., resilient supports having a specific spring constant, a rotatably-supported member having a specific asymmetric mass distribution, a movable platform having a particular shape, etc.), the behavior of substances retained with a container of interest (e.g., 96 well microtiter plate, 1536 well microtiter plate, etc.) are visually monitored to determine when a desired agitation behavior (e.g., vortexing) is established. Such desired agitation behavior can then be associated with a specific revolutions-per-minute (rpm) of rotatably-supported member 118 in a variety of ways known in the art. For example, rpm can be electrically determined using a magnetic pick-up coil and a frequency meter or oscilloscope, or optically determined via a stroboscope. In embodiments in which rotatably-supported member 118 is driven by drive gas, the desired agitation behavior can be associated with a specific drive gas flow rate by placing a flow meter in-line and noting the flow rate at the onset of the desired agitation behavior.

Figure 8:
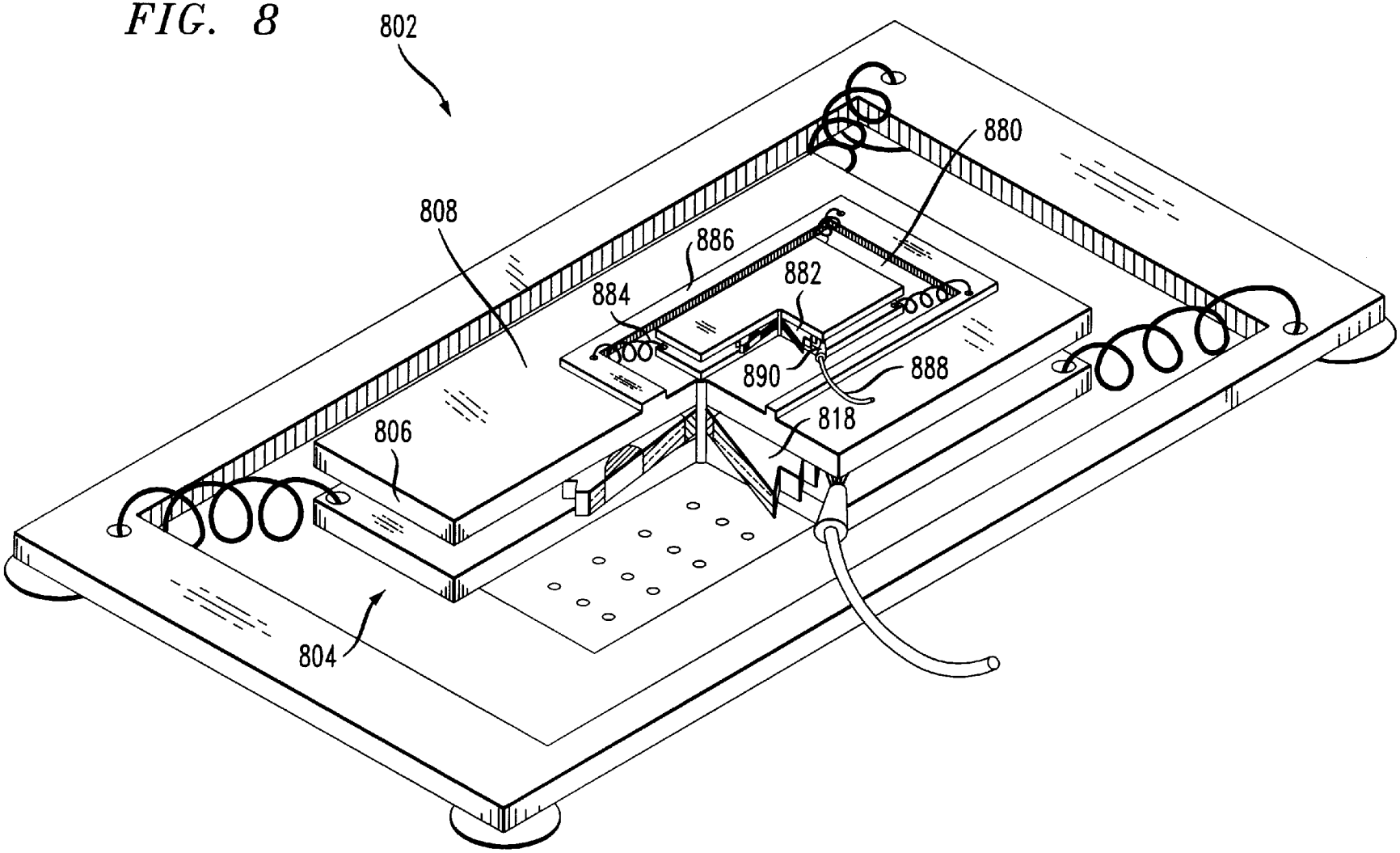
FIG. 8 depicts an agitator having dual movable assemblies in accordance with the present teachings.

Illustrative agitator 102 provides a simple, reliable device for generating a vortex within a substance contained in a vessel. FIG. 8 depicts a second illustrative embodiment of an agitator 802 in accordance with the present teachings.

Agitator 802 is adapted to provide random and very efficient mixing action. In illustrative agitator 802, upper movable assembly 880 is suspended within frame 886 by resilient supports 884. Frame 886 is disposed on upper surface 808 of top plate 806 of lower movable assembly 804. Frame 886 can be formed integrally with upper plate 806, (e.g., molded as part of upper plate 806) or, alternatively, can be suitably attached to upper plate 806 in any convenient manner (e.g., epoxy, etc.). Sufficient spacing should be provided between upper movable assembly 880 and upper surface 808 so that when a container is placed on the upper movable assembly, it does not "bottom out," touching upper surface 808. Such spacing is dependent upon the height of the frame 886 above upper surface 808 and the spring constant of resilient supports 884.

In an alternative embodiment (not shown), a portion of upper plate 806 can be removed such that upper movable assembly 880 is suspended by resilient supports 884 within such a cut-out region. In such an embodiment, frame 886 may not be necessary. Rather, resilient supports 884 can be attached directly to upper plate 806. Care must be taken to ensure that when a container is placed on upper movable platform 880, the weight of such a container does not force the upper movable assembly to contact first rotatably-supported member 818.

Upper and lower movable assemblies 804 and 880 are arranged in the manner of movable assembly 104 of FIG. 1. Upper movable assembly 880 includes second rotatably-supported member 882 having an asymmetric weight distribution, drive gas feed conduit 888, nozzle 890, and the like. Agitator 802 allows for the generation of random and very efficient mixing motion via the superimposition of different rotation patterns generated by the two movable plates.

EXAMPLE 1

Agitators similar to agitator 102, as depicted in FIG. 1, and in accordance with the present teachings, were fabricated. The agitators were able to generate a vortex in the wells of 96-, 384- and 1536-well microtiter plates. The upper and lower plates (e.g., plates 106 and 112 of agitator 102), which were made from plexiglass, had a standard outer dimension of 5 inches by 3 inches. Conventional "expansion-type" springs were used as the resilient supports (e.g., supports 128 of agitator 102). The springs used in the agitators had spring constants in the range of from about 0.8 to 65 lb/inch. The spring constant was selected based on several performance considerations. Such considerations included, for example, avoiding system resonance over the expected operating frequencies and obtaining a suitable amplitude of deflection, among other considerations.

All rotationally-supported members were made from plastic, including Delrin™, which is an acetal-based plastic made by DuPont, Nylon and Fiberglass. High speed ball bearings, as well as self-lubricating composite bearings, were used in conjunction with the rotatably-supported member.

The rotational speed for developing a vortex within wells of the microtiter plates varied as a function of well size. In particular, for a 96-well plate having a well diameter of about 5 mm, vortexing began at about 1300 RPM of the rotatably-supported member. For a 1536-well plate having a well diameter of about 1 mm, vortexing was observed in the range of about 10,000 RPM.

The above-described illustrative embodiments of the present agitator use a "direct"- drive system. In the illustrated direct-drive system, the action of the drive gas against the rotatably-supported member drives said rotatably-supported member. While such a direct-drive system is particularly well suited for generating relatively higher agitation rates, other arrangements are advantageously used when lower agitation rates are desired. Lower agitation rates may be desired, for example, when attempting to develop a vortex within a fluid contained in a vessel having a very large diameter (there is an inverse relationship between the agitation speed required for vortexing and container diameter).

Figure 9:
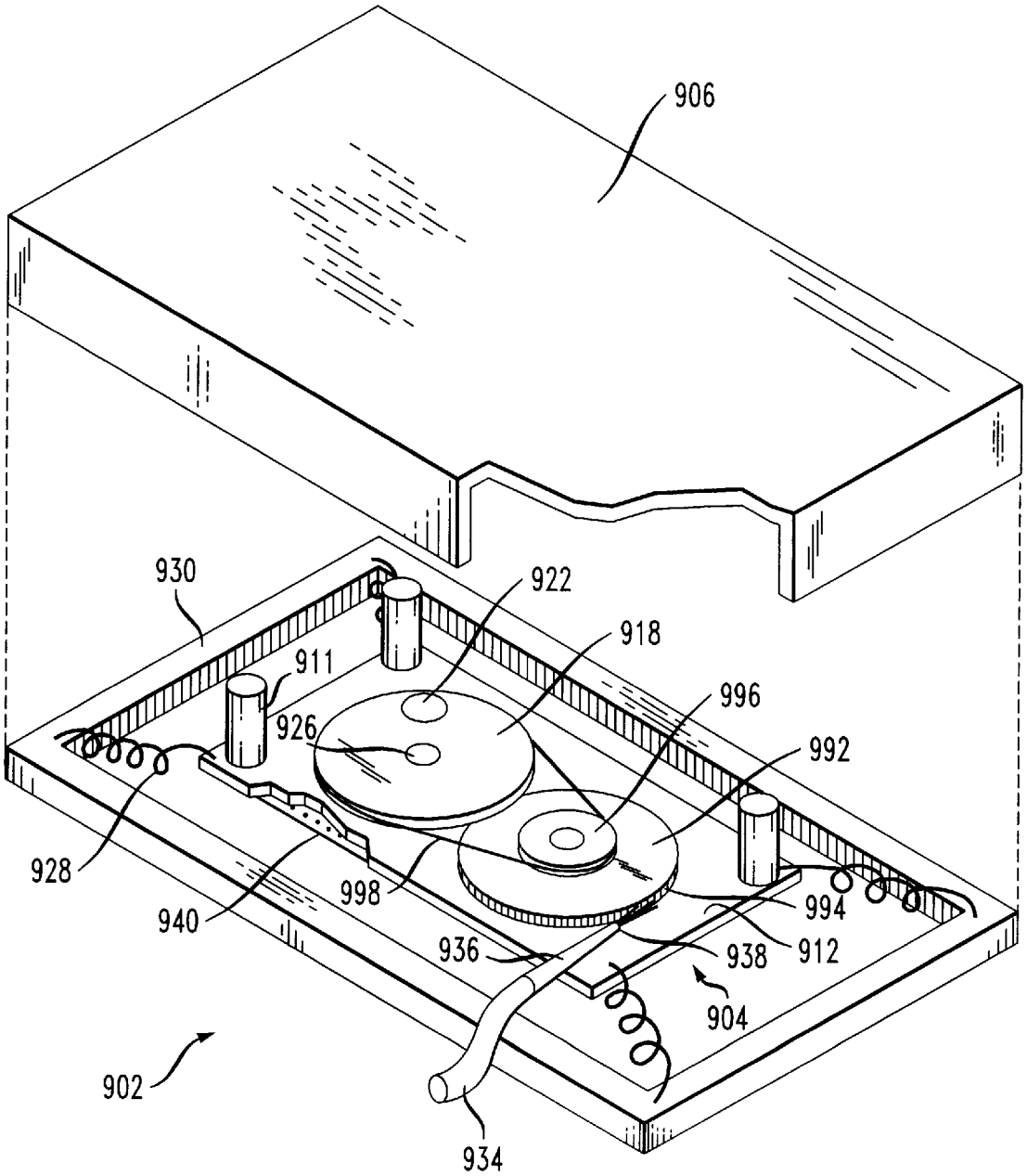
FIG. 9 depicts an agitator having a belt-drive system in accordance with the present teachings.

FIG. 9 depicts an exploded view of an illustrative embodiment of an agitator 902 particularly well suited for generating lower agitation rates. Agitator 902 advantageously incorporates a belt-drive system for driving the rotatably-supported member. The overall layout of agitator 902 is similar to the previously-described illustrative agitators. In particular, agitator 902 comprises movable assembly 904 which has a receiving surface 908. Movable assembly 904 is suspended within frame 930 via resilient supports 928 that attach to lower plate 912 of the movable assembly.

Movable assembly 904 comprises spaced upper and lower plates 906 and 912, respectively. In FIG. 9, movable assembly 904 is depicted with upper plate 906 removed so that rotatably-supported member 918 and the drive system, which in illustrative agitator 902 are disposed on lower plate 912, are visible. Separators 911 are used for spacing the upper and lower plates 906 and 912.

In the illustrated embodiment, rotatably-supported member 918 is rotatable about pin 926 that passes through it and defines the rotational axis thereof. Like agitator 102, the mass of rotatably-supported member 918 is asymmetrically distributed about its rotational axis. In the illustrated embodiment, such an asymmetrical mass distribution is achieved utilizing an eccentrically located (i.e., not aligned with the rotational axis) loading element 922. As the rotatably-supported member 918 rotates, force is non-uniformly applied to resilient supports 928 due to the asymmetric mass distribution of the rotatably-supported member. As a result, movable assembly 904 is guided into orbital motion as previously described.

Like agitators 102 and 802, illustrative agitator 902 is advantageously structured to return movable assembly 904 to a home position when agitating motion ceases. Since agitator 902 will typically be agitating relatively massive loads, it advantageously includes a secondary support device for providing additional support for movable assembly 904. In the illustrated embodiment, the secondary support device is realized as distribution plate 940, configured in the manner of distribution plate 140, previously described. (See FIG. 1 and accompanying description). Moreover, agitator 902 advantageously includes a braking mechanism (not shown), such as previously described.

Illustrative agitator 902 utilizes a belt-drive system for driving the rotatably-supported member, as opposed to the direct-drive system of agitators 102 and 802. The belt-drive system includes a rotatable drive member 992, pulley 996, belt 998, nozzle 936 and drive gas feed conduit 934.

In operation, drive gas (e.g., compressed air or other suitable fluid) is delivered to drive member 992 via nozzle 936 that depends from an end of drive gas feed conduit 934. Nozzle end 938 directs drive gas towards the perimeter 994 of drive member 992 along a path that is substantially tangential to said perimeter. Drive gas impacting the perimeter of drive member 992 causes the drive member to rotate. Like rotatably-supported member 118, the perimeter of drive member 992 is advantageously physically adapted to capture the tangentially-directed drive gas using uniform serrations, vanes, teeth and the like.

An arrangement for transferring the rotation of drive member 992 to rotatably-supported member 918 is provided. In the illustrated embodiment, the arrangement consists of pulley 996 that is rigidly attached to drive member 992, and belt 998 that mechanically links pulley 996 to rotatably-supported member 918.

In embodiments in which agitator 902 is intended to agitate materials contained in very large vessels, the agitator provides a low agitation rate. Consequently, rotatably-supported member 918 should be driven at a low rate of speed. Turning down the flow of compressed air to slow the rate of rotation of rotatably-supported member 918 may become problematic once a certain minimum flow rate is reached. As an alternative, a low drive speed may be obtained by providing pulley 996 having a smaller circumference than that of drive member 992. It will be appreciated that, when the drive system is so configured, the velocity of pulley 996 at its perimeter is lower than the velocity of drive member 992 at its perimeter. As such, rotatably-supported member 918, driven by pulley 996, rotates at a lower rpm than drive member 992. In this manner, the rate of rotation of rotatably-supported member 918 may be reduced to very low speeds while drive gas flow is maintained at a suitably high rate.

EXAMPLE 2

An agitator incorporating a belt-drive system for driving the rotatably-supported member was fabricated. All parts were made out of plastic. The rotatably-supported member is a glass-filled nylon, and the weights used to provide the mass loading were either steel inserts or lead that was poured into a pre-drilled cavity in the rotatably-supported member. The pulley was made of Delrin™ (DuPont), and bearings for the rotatable members were ball bearings or non metallic bearings such as Rulon™ J available from Dixon Industries. A "friction-type" belt (e.g., an O-ring) or Polycord™, available from SMI Small Parts Inc. of Miami Lakes, Fla., was used for connecting the pulley to the rotatably-supported member.

The upper and lower plates were substantially larger than those used for the agitators described in EXAMPLE 1, and were able to support a vessel having a diameter as large as about 10 inches. The agitator developed a maximum agitation speed of about 1000 rpm.

It is to be understood that the embodiments described herein are merely illustrative of the many possible specific arrangements that can be devised in application of the principles of the invention. Other arrangements can be devised in accordance with these principles by those of ordinary skill in the art without departing from the scope and spirit of the invention. It is therefore intended that such other arrangements be included within the scope of the following claims and their equivalents.

We claim:

1. An article comprising:

a movable assembly supported by resilient supports;

a rotatably-supported member in mechanical communication with said movable assembly, the rotatably-supported member having a rotationally asymmetric weight distribution;

a secondary support device for supporting said movable assembly, said secondary support device comprising an element operable to distribute lift gas across a surface of the movable assembly such that said lift gas at least partially supports said movable assembly; and a drive for causing the rotatably-supported member to rotate, wherein, upon rotation of the rotatably-supported member, the movable assembly is placed in orbital motion due to the rotationally asymmetric weight distribution of said rotatably-supported member.

2. The article of claim 1 further comprising:

a frame, wherein the resilient supports are attached to said frame.

3. An article comprising:

a movable assembly supported by resilient supports;

a rotatably-supported member supported by said movable assembly, the rotatably-supported member having a rotationally asymmetric weight distribution; and a drive for causing the rotatably-supported member to rotate, said drive using a flow of drive gas to cause rotation of said rotatably-supported member.

4. The article of claim 3 further comprising a frame wherein said resilient supports are attached to said frame.

5. The article of claim 4, and further comprising:

a secondary support device for supporting the movable assembly.

6. The article of claim 5, wherein the secondary support device comprises a distribution plate operable to distribute lift gas across a surface of the movable assembly such that the lift gas at least partially supports the movable assembly.

7. The article of claim 3, wherein the movable assembly comprises first and second spaced, superposed plates.

8. The article of claim 7, wherein the rotatably-supported member is disposed in the space between the first and second plates of the movable assembly.

9. The article of claim 8, wherein the rotatably-supported member comprises a load member disposed at a location that is offset from a rotational axis of the rotatably-supported member, thereby providing the rotationally asymmetric weight distribution.

10. The article of claim 9, wherein the load member is movable in a radial direction, thereby providing a variable rotationally asymmetric weight distribution.

11. The article of claim 3, wherein the drive comprises a nozzle operable to deliver said drive gas to a perimeter of the rotatably-supported member, wherein impact of said drive gas at the perimeter of the rotatably-supported member causes the rotatably-supported member to rotate.

12. The article of claim 11, wherein the perimeter of the rotatably-supported member is physically adapted to receive said drive gas.

13. The article of claim 12, wherein the physical adaption is a plurality of serrations.

14. The article of claim 3, wherein the drive comprises:

a rotatable drive member;

a nozzle operable to deliver said drive gas to a perimeter of the rotatable drive member, wherein impact of said drive gas at the perimeter of the rotatable drive member causes the rotatable drive member to rotate;

a pulley attached to the rotatable drive member; and a belt for mechanically linking the pulley to the rotatably-supported member, wherein, as the pulley rotates due to the rotation of the rotatable drive member, the belt moves causing the rotatably-supported member to rotate.

15. The article of claim 14, and further wherein the pulley has a perimeter that is smaller than the perimeter of the rotatable drive member, so that the rotatably-supported member is rotated at a speed slower than a speed at which the rotatable drive member rotates.

16. The article of claim 3, wherein the resilient supports are springs.

17. The article of claim 3, wherein attachment points at which the resilient supports are attached to the movable assembly are symmetrically distributed over a surface of the movable assembly.

18. The article of claim 17, wherein the attachment points collectively define a square.

19. An article comprising:

a movable assembly supported by resilient supports;

a rotatably-supported member supported by said movable assembly, the rotatably-supported member having a rotationally asymmetric weight distribution;

a drive for causing the rotatably-supported member to rotate; and a second movable assembly that is supported, via a second set of resilient supports, from the movable assembly.

20. The article of claim 19, and further comprising:

a second rotatably-supported member in mechanical communication with the second movable assembly, the second rotatably-supported member having a rotationally asymmetric weight distribution; and a second drive for causing the second rotatably-supported member to rotate.

* * * * *